US006083021A

United States Patent [19]

Lau

[11] Patent Number: 6,083,021

[45] **Date of Patent: *Jul. 4, 2000**

[54] FLUORESCENT LIGHT BALLAST LAMP MOUNTING SOCKET CONSTRUCTION

[76] Inventor: Kenneth Lau, 4327 Point Reyes Ct., Carlsbad, Calif. 92008

[ * ] Notice: This patent is subject to a terminal disclaimer.

[21] Appl. No.: 09/030,404

[22] Filed: Feb. 25, 1998

Related U.S. Application Data

[63] Continuation-in-part of application No. 08/563,783, Nov. 27, 1995, abandoned, which is a continuation-in-part of application No. 08/188,807, Jan. 31, 1994, Pat. No. 5,471,375, which is a continuation-in-part of application No. 08/832,988, Feb. 10, 1992, abandoned.

[51] Int. Cl.[7] ..... F21S 5/00; F21V 29/00

[52] U.S. Cl. ..... 439/227; 363/260; 362/216; 362/221; 362/294

[58] Field of Search ..... 439/227, 239, 439/226; 363/260; 362/216, 221, 294

[56] References Cited

U.S. PATENT DOCUMENTS

| | | | |
|---|---|---|---|
| 2,817,004 | 12/1957 | Baumgartner et al. | 362/216 |
| 4,109,303 | 8/1978 | Hetherington | 362/216 |
| 4,386,296 | 5/1983 | Beck | 315/62 |
| 4,549,251 | 10/1985 | Chapman et al. | 362/216 |

FOREIGN PATENT DOCUMENTS

| | | | |
|---|---|---|---|
| 2146755 | 4/1985 | United Kingdom | 362/225 |
| 2180988 | 4/1987 | United Kingdom | 362/217 |

*Primary Examiner*—Gary F. Paumen

[57] ABSTRACT

A lamp assembly mount is adapted to receive a specific commercially available fluorescent lamp known as the "2D" lamp, which is commercially produced in several different sizes and commensurate wattage ratings. By taking advantage of certain structure in the design of the 2D lamp that is specific to its wattage rating, the lamp assembly mount will only receive the correct lamp, eliminating the possibility of mounting under-or over-wattage fluorescent lamps of different base configurations.

15 Claims, 8 Drawing Sheets

FLUORESCENT LIGHT BALLAST LAMP MOUNTING SOCKET CONSTRUCTION

This application is a continuation-in-part of Ser. No. 08/563,783 filed Nov. 27, 1995, now abandoned which is continuation-in-part of 08/188,807, filed Jan. 31, 1994 now U.S. Pat. No. 5,471,375, which was a continuation-in-part of Ser. No. 08/832,988 filed Feb. 10, 1992, now abandoned.

BACKGROUND OF THE INVENTION

It is a known fact that on the average, fluorescent lights consume up to 75% less energy than incandescent lamps with the same light output. The EPA estimates that if Americans were to convert from incandescent lamps to fluorescent, the energy saved would be equivalent to removing one third of all automobiles from the road. Fluorescent lights also have substantially longer service lives, up to ten times the life span of incandescent bulbs, and new generations of highly efficient fluorescents with excellent color rendition are being produced in various compact shapes and sized all the time.

Fluorescents and other higher efficiency lamps, of which fluorescents are the cheapest and most efficient, cannot operate on bare household AC current but require a ballast and a starter to provide the optimum starting and operating voltages. A screw fluorescent conversion for an incandescent mount has all three on-board, sometimes having a replaceable fluorescent tube element. The starter and the ballast circuitry may be integrated, or the starter may be integral with the lamp.

Aside from the considerably higher initial cost, traditionally there are two hurdles to converting from incandescent to fluorescent fixtures. First, the fluorescent tube (discharge tube) produces a limited amount of light per linear unit of length, requiring it to be many times longer than the thickness of an incandescent bulb. This requires inventive folding and convoluting to even approach conforming to the same space requirements as incandescents. Some incandescent installations are still too confined to permit upgrading.

Second, the weight and bulk of the conventional magnetic, transformer-style ballast makes it difficult for fluorescents to compete in some installations with the lightweight, compact incandescent. Conventional ballasts have copper wire transformer coils which make it very heavy, in addition to being bulky. These limitations have made it difficult to provide a screw-in fluorescent fixture that could be used in a normal incandescent light bulb socket.

With the development of electronic ballasts, the weight and bulk limitations formerly dictated by the coiled wire magnetic ballasts has been partially eliminated. Besides the weight and overall volume restrictions of the ballast, magnetic ballasts also must be provided as a single mass since the coils must be as close as possible to one another for the most efficient transforming.

Ballast as a design limitation has largely disappeared as magnetic ballasts have given away to modern electronic ballasts. The new ballasts may be arranged and configured to accommodate more desirable spatial distributions conforming more closely to the shape of the space available. This is exemplified in the patent to this case, U.S. Pat. No. 5,471,375 issued Nov. 28, 1995. Also by the same inventor, U.S. Pat. No. 5,362,246 issued Nov. 8, 1994, discloses a compact fluorescent replacement with a special initial installation mode, and U.S. application Ser. No. 08/221,803 filed Apr. 1, 1994 disclosed a replacement system particularly useful to large scale installations, enabling hotel corridors and restaurants to upgrade without the usual high cost of completely ripping out the old mounting structure, and achieving true replacement with self-cooled fixtures, not the recessed "conversions" destined by design to burn out from overheating with a year or two.

In 1981, Thorn EMI lighting of the United Kingdom launched its 16 watt compact fluorescent lamp line called the "2D", named for its resemblance to two back-to-back D's. The 2D series has been developed from 1981 to the present to include different sizes and different power level fluorescent lamps, and is now owned by General Electric Lighting. The initial 16 watt lamp has been expanded to a line of three different base size configurations and five different wattage levels ranging from 10 watts to 38 watts for a total of five different lamps.

In addition to the variations in wattage rating and overall base configurations, two of the 2D lamps come in yet another variation which is identical to the original except that they incorporate the starter in the lamp base, and thus require only two pins to connect to a pin socket platform. These two pins are positioned at loci on the pin platform different from any of the four pins of the alternate configuration, without the starter, however. The lamps that do not include the starter have four-pin plug structure, so that there are altogether three different lamp configurations and two different pin platform configurations.

Currently there are two basic commercially available lamp mounting sockets. One is for all the 2-pin lamps, and the other is for the 4-pin lamps. The single 2-pin lamp mounting socket will receive either of the two available 2-pin lamp sizes, and the 4-pin socket, will receive either of the three available 4-pin lamp sizes. The lamp fixture, however, contains the ballast appropriate to only a single wattage. Therefore, with current lamp mounts there is the distinct possibility that lamps of incorrect wattage rating will be plugged into available lamp assembly mounts. Although there may be coincidental limitations on the available volume due to surrounding structure which would make impossible mistaken use of a large tube in a lamp mounting socket for a small tube, the converse would always be possible. The 10-watt unit will fit all of the other sizes, and would be either immediately burned out, or have a very limited life span, if inadvertently plugged into a 38-watt lamp mounting socket.

There is a need for a lamp assembly mount which is specifically tailored to the 2D lamp series and which manifests multiple improvements over the prior art lamp base assemblies in both weight and volume and eliminates the possibility of inadvertent power mismatches.

SUMMARY OF THE INVENTION

The instant invention fulfills the above stated needs by providing a fluorescent lamp assembly mount, which includes a pin socket platform and ballast, which defines structure specific to a single wattage rating.

Two groups of keying features of the lamp base are used in the alternative. The first uses the thickness of an end wall in the 2D lamp base plus the spacing between its discharge tube support arms. In the second scheme, the keying means are provided by the details of construction of the lamp base, wherein blocking structure is incorporated into the lamp assembly mount to interfere with baffles or other structure of the wrong-sized lamp bases.

DETAILED DESCRIPTION OF THE PREFERRED EMBODIMENT

Figure 1:
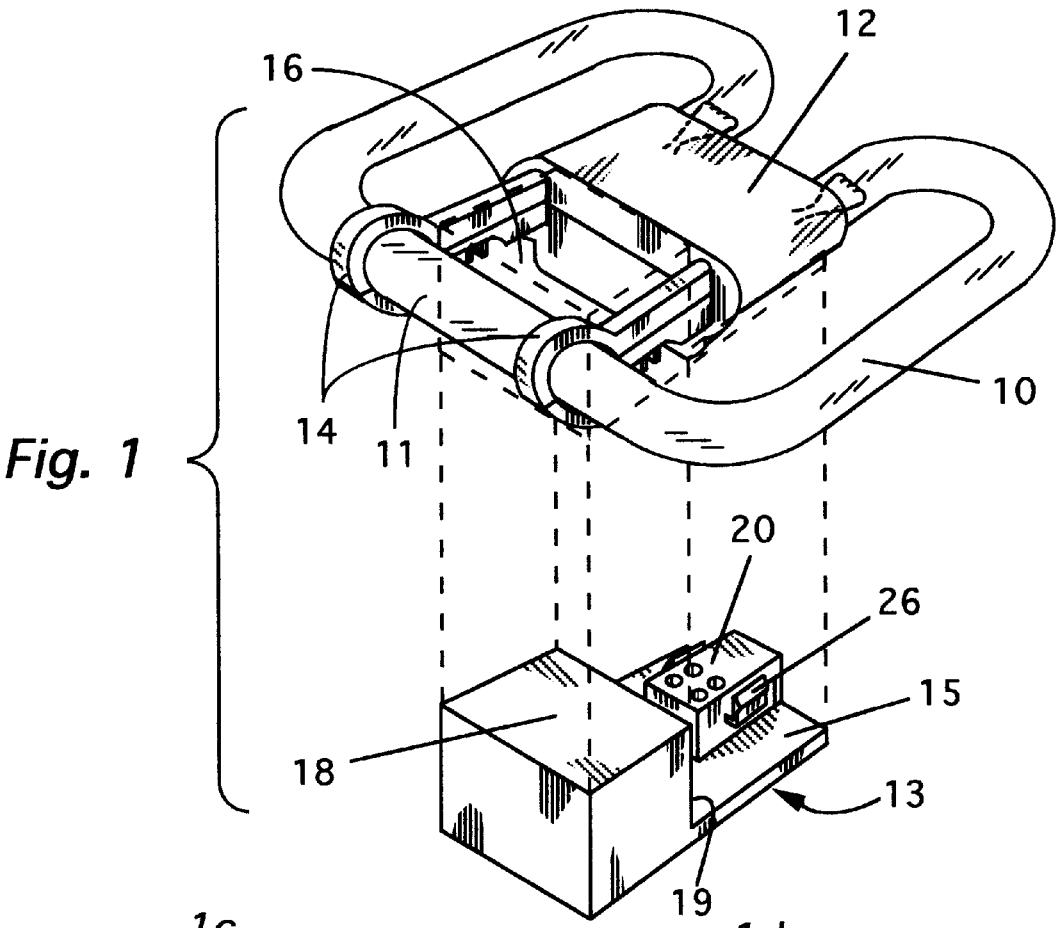
FIG. 1 is an exploded perspective view of a prior art 2D fluorescent lamp and a novel ballast-key lamp assembly mount.

As used in this disclosure, the term "lamp assembly" includes the fluorescent discharge tube 10 having a straight central segment 11 and the lamp support housing 12, which supports the tube. The lamp assembly is removably connected to lamp assembly mount 13, which is the invention. As shown in FIG. 1, lamp support housing 12 includes a pair of supports 14 which define a rectangular space 16 therebetween, and in the illustration of FIG. 1, the ballast housing 18 having a rear wall 19 has a similar rectangular shape which fits into the space 16 as indicated by dashed lines. The ballast housing and pin socket platform 20 are mounted on a base member 15.

Figure 1A:
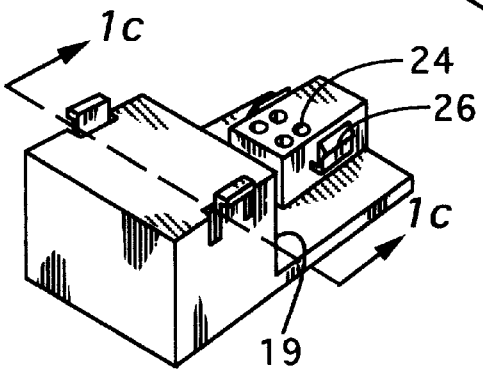
FIG. 1*a* is a perspective of the lamp assembly mount of FIG. 1 illustrating lateral support arm clips.
Figure 1B:
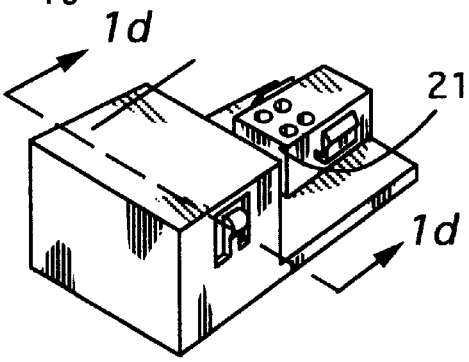
FIG. 1*b* is similar to FIG. 1*a* but with a slightly different clip type.
Figure 1C:
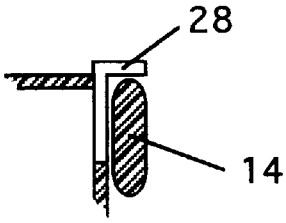
FIG. 1*c* is a section taken along line 1*c*—1*c* of FIG. 1*a;*
Figure 1D:
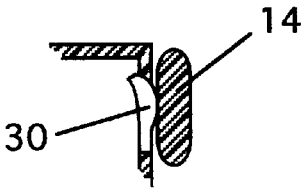
FIG. 1*d* is section taken along line 1*d*—1*d* of FIG. 1*b;*
Figure 5:
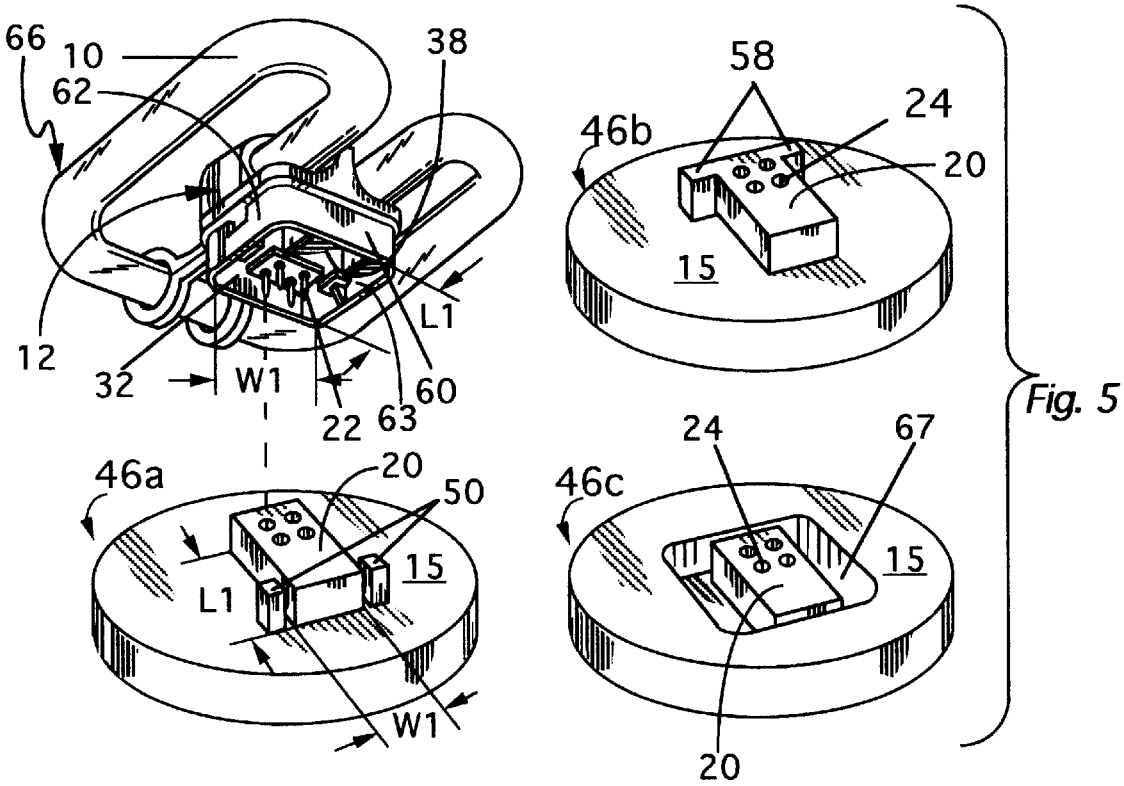
FIG. 5 illustrates three different novel configurations of lamp assembly mount for the lowest-wattage prior art 2D fluorescent lamp seen in the perspective in the upper left.

The lamp assembly mount is the principal keying feature of the arrangement of FIG. 1, and when the ballast housing fits snugly into the space 16, the pin socket platform 20 having a front wall 21 fits up into the concave bottom cavity 38 of lamp support housing 12 as can better be seen in FIG. 5, with the connector pins 22 fitting into the pin sockets 24 of the pin socket platform 20. When this occurs, resilient side clips 26 are deflected and then snap back to engage horizontal detent structure in lamp support housing 12 for a secure mount. These side clips 26 and the corresponding structure on the different lamp assembly mounts is omitted from most of the drawings to enable the invention to be more clearly illustrated, but all lamp support housings and lamp assembly mounts would have this structure. This attachment structure could be supplemented or replaced by the lateral clips 28 shown in FIG. 1*a*, which snap around the supports 14 as shown in FIG. 1*c*. A slightly different version 30 of the clip is shown in FIG. 1*b*, illustrated in its support-engaging mode in FIG. 1*d*.

The prior art "2D" lamp assembly of FIG. 1 is presently made in three physical sizes and five wattages, the larger two of the physical sizes each being produced in two different power capacities. Each of the three different sizes of the 2D lamp assembly has a larger fluorescent tube for each size increase, and the supports 14 are correspondingly spaced farther apart.

Inside the lamp support housing 12 of the lamp assembly, adjacent the array of the four connector pins 22, there is a downwardly extending front end wall 32. The thickness and length dimensions of this front end wall also increase with the incremental size increase of the lamp assembly, as made clear by the illustrations of FIG. 10.

This being the case, since the front end wall becomes thicker as the size of the fluorescent tube gets larger, a ballast housing 18 made according to the invention which defines an end wall space 34 will permit the seating of the appropriate lamp size and all smaller lamps, since the end wall becomes progressively narrower as the assemblies gets smaller.

Figure 2:
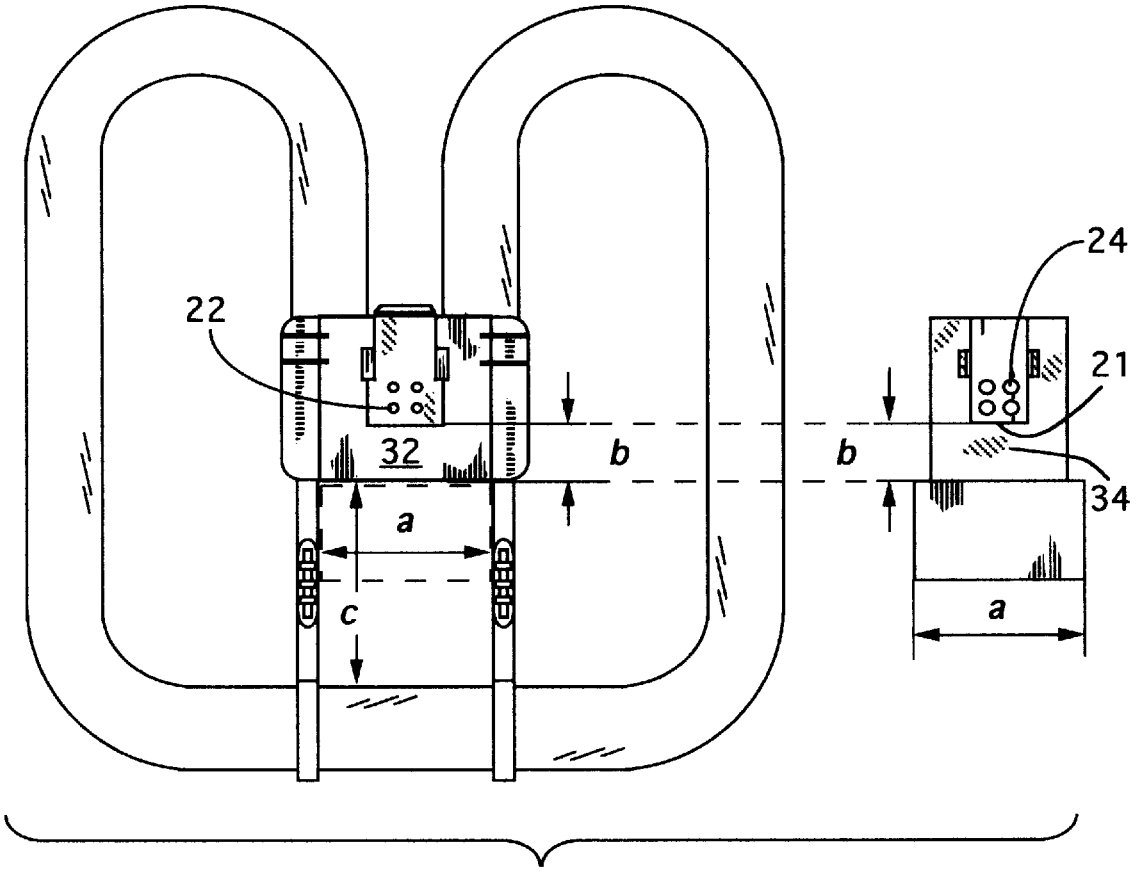
FIG. 2 is a bottom plan view of a prior art 2D fluorescent lamp similar to that of FIG. 1 but showing the lamp assembly mount alongside illustrating the correspondence of clearance measurements.
Figure 3:
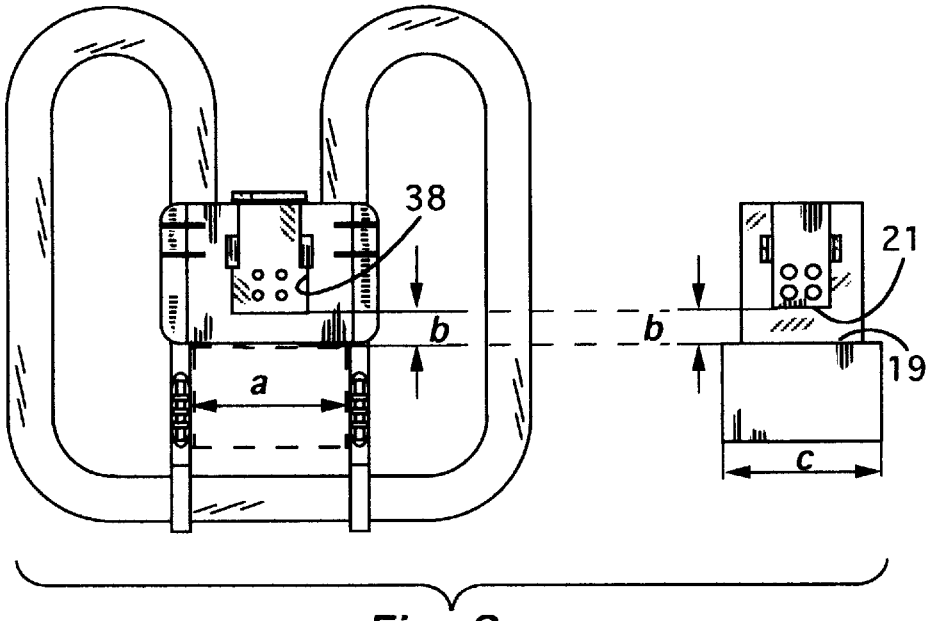
FIG. 3 is a bottom plan view of a prior art 2D fluorescent lamp similar to FIG. 2 but with a smaller sized and lower-powered lamp assembly.

As discussed, the inter-support spacing "a" shown in FIGS. 1,2 and 3, becomes wider as the lamps get larger, so that a ballast housing such as 18 in FIG. 1 will fit one size lamp assembly and all larger sizes. Therefore, if the appropriate space 34 (having a dimension "b") and inter-support diameter "a" of the ballast housing are chosen correctly for a particular size, neither a larger or a smaller lamp assembly will fit that particular lamp assembly mount. In this way, all lamp assembly mounts could conceivably be keyed to fit only one of the three 2D lamp assemblies, based strictly on the ballast housing dimensions and the space provided to accommodate the front end wall adjacent the pin socket platform.

Figure 12:
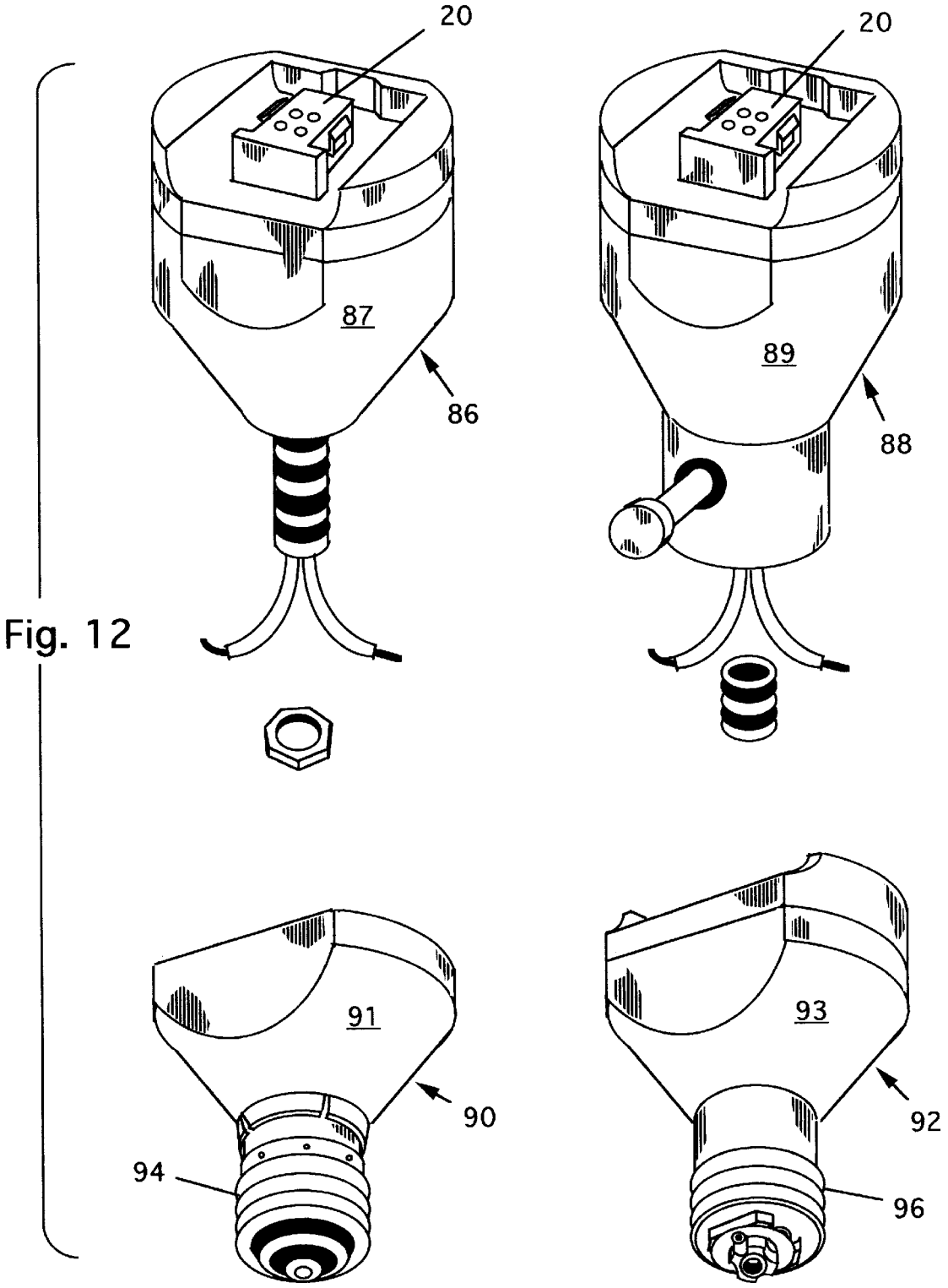
FIG. 12 is a perspective view of a variety of mounting options that can be used with any of the novel keyed lamp assembly mounts.

However, the configuration in which the location of the ballast housing is within the volume area 16 defined by the 2D lamp, specifically between the supports 14, is intended for use more with wall mounts, and some recessed mounts, where adequate space for the ballast housing is a problem. However, if axial space is not a problem, the ballast may be incorporated in a different region of the lamp assembly mount rather than between the braces, such as is shown in FIG. 12. In this case one of the keying features of the lamp assembly mount has been lost, and must be replaced if unique keying is to be preserved.

Figure 6:
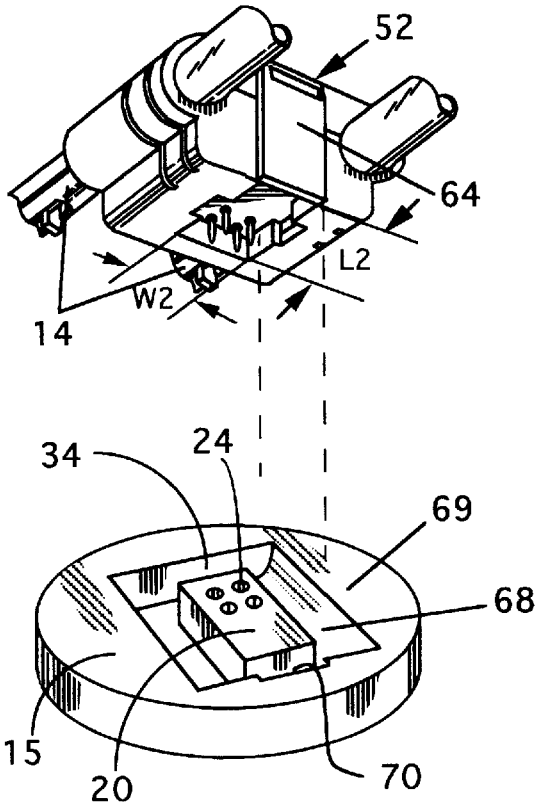
FIG. 6 is a exploded perspective view of a prior art 2D fluorescent lamp and a novel lamp assembly mount illustrating the inter-fitting of the two parts in use.
Figure 7:
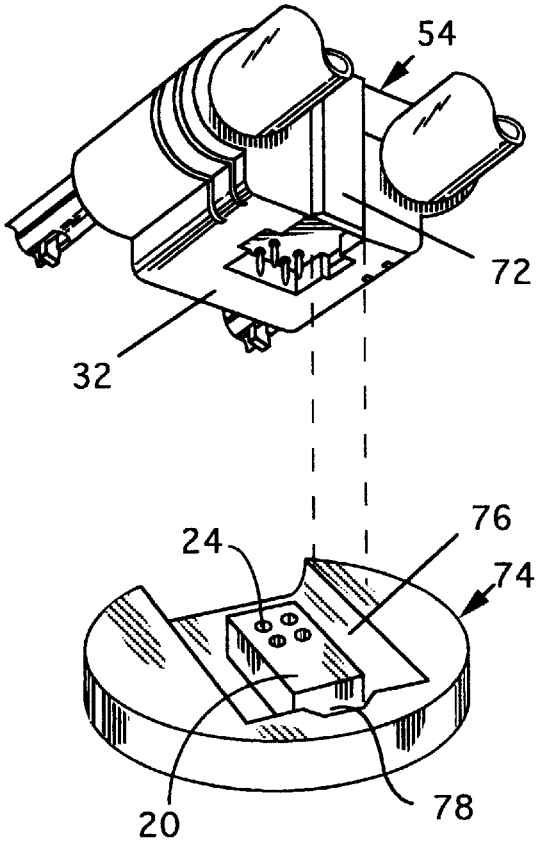
FIG. 7 is an exploded perspective identical to FIG. 6 but illustrating the third type of prior art 2D fluorescent lamp and its inter-fit with its novel lamp assembly mount.

The second keying scheme, illustrated in FIGS. 5 through 11, takes advantage of the bottom cavity 38 structure internal to the lamp support housing 12 of the lamp assembly to ensure that only the proper wattage lamp is used in any particular lamp assembly mount, independently of the spacing of the tube supports. Bottom cavity 38 forms a front wall 32, a left side 62, a right side wall 63, and a rear wall 60. Bottom cavity 38 has a width W1 and a length L1. The three lamp support housing configurations in which the 2D lamp are available are shown in FIGS. 5,6 and 7, in order of increasing size, also corresponding to increased power rating. The first prior art lamp assembly 66, shown in FIG. 5, is the 10-watt unit and it's bottom cavity 38 is characterized by defining corner spaces which are most easily visualized by reference to FIG. 10. Designated as Model "A" for identification as the smallest of the units, the lamp support housing 12 in that figure has a pair of downwardly extending baffles or partitions or walls 39 which define corner pockets 40, and a second pair of open spaces 42 adjacent the pin platform 44. This particular lamp assembly, identified as 66, can be keyed by providing the "A" style lamp assembly mount 46*a*, also shown in FIG. 10, with free-standing posts 50 which fit into the clearance provided by the corner pockets 40 when the two units are mated. As can be seen by inspecting FIG. 10, lamp support housings 52 and 54, representing Models "B" and "C" respectively, do not have open spaces that act as corners and thus posts 50 would not permit either of these lamp support housings to seat. It may be easier to visualize this from FIGS. 6 and 7. The designations, "Model A", "Model B", and "Model C" refer to the three physical configurations that the 2D lamp assemblies are made in, with Models B and C each being manufactured in two alternative power ratings.

Figure 10:
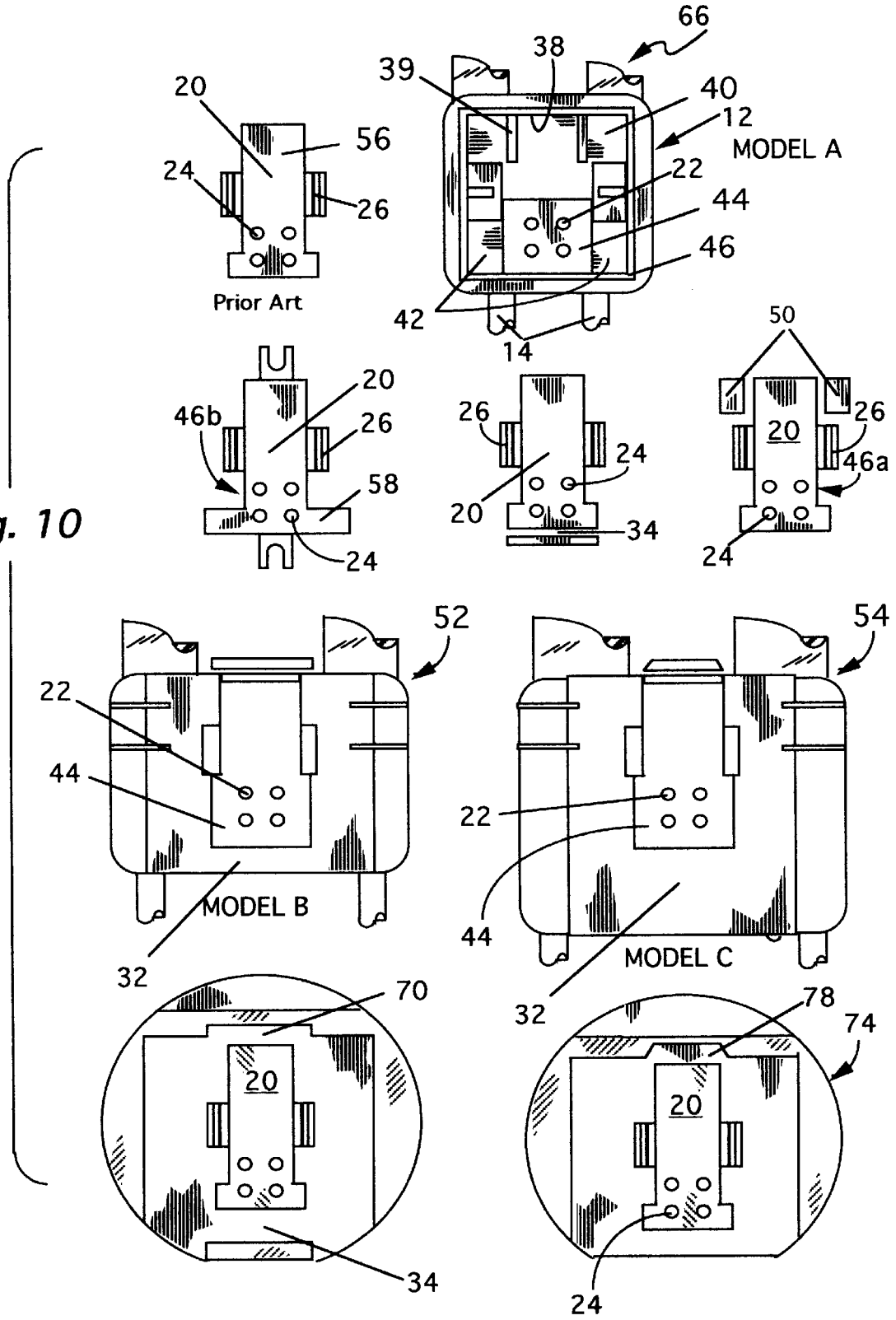
FIG. 10 illustrates a diagrammatic platform view of the three prior art 2D fluorescent lamp and the principle novel lamp assembly mounts that a re used with them just below.
Figure 11:
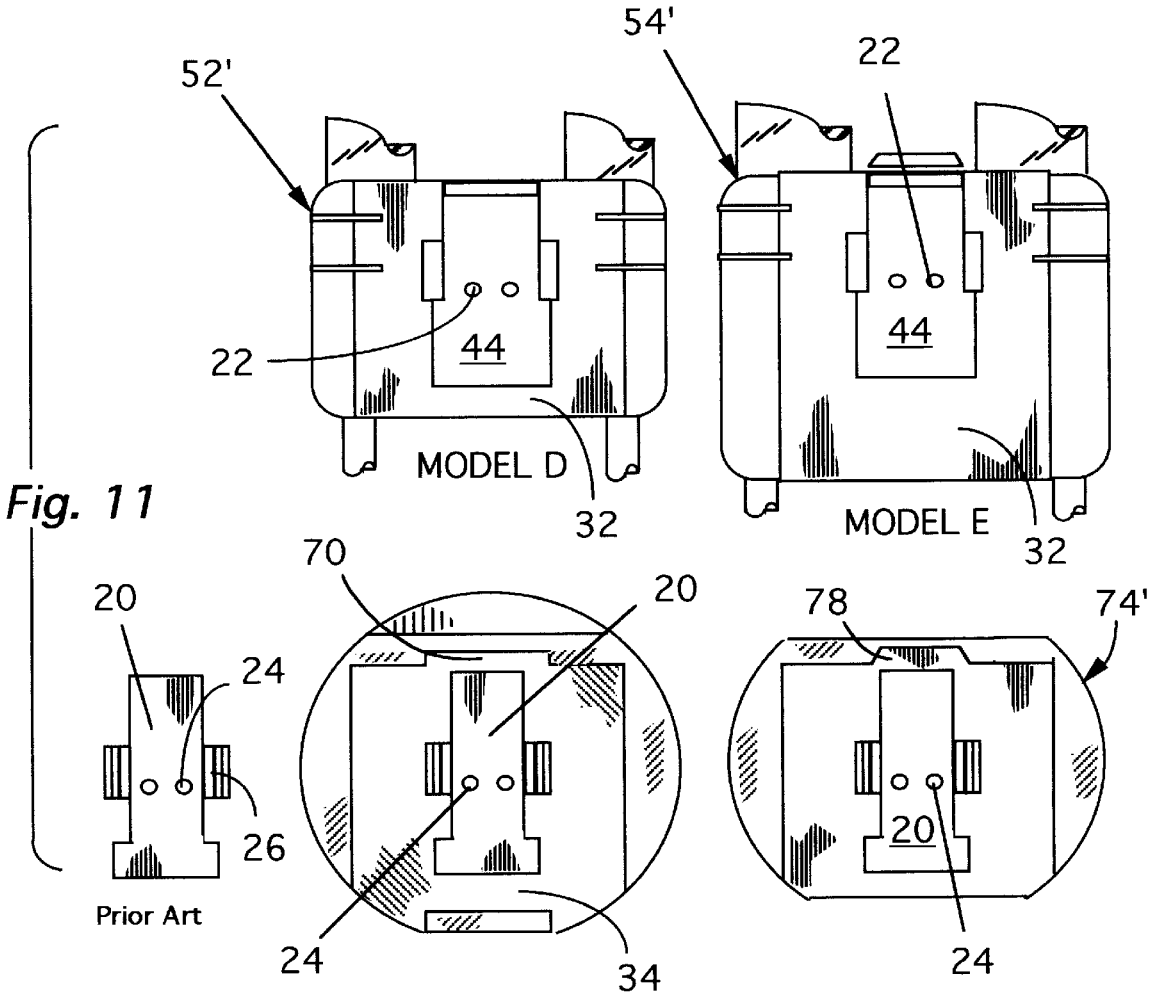
FIG. 11 is another diagrammatic plan form view similar to FIG. 10 but illustrating the prior art 2-pin fluorescent lamps and the novel lamp assembly mounts having built-in starters.

The prior art pin socket platform indicated at 56 defines the pin sockets 24, but has no other structure that is capable of keying the lamp support housings, and would permit installation in any of the cavities of the three lamp support housings identified as Models A,B, or C shown of FIG. 10.

The Model A lamp support housing configuration, having the corresponding lamp assembly mount identified as 46*a*, is illustrated in two other lamp assembly mount configurations 46*b* and 46*c* in FIG. 5. Each lamp assembly has a base 15 and a pin socket platform 20. The lamp assembly mounting 46*a* embodiment has been described in conjunction with lamp support housing 12 in FIG. 10. Lamp assembly mount 46*b* is similar in that the pin socket platform 20 is about the same, but this model is keyed by ears 58 which fit into the other open spaces 42 of the lamp base.

The third and last embodiment used with the Model A lamp assembly is lamp assembly mount 46*c*. This model has a pin socket platform 20 with no other keying structure, the keying in this case being accomplished entirely by the relatively close fit of the downwardly extending walls 32, 60, 62 and 63 of the lamp support housing in the matingly configured closed loop cavity or channel 67. It is clear from viewing FIGS. 5,6 and 7 simultaneously that the larger embodiments of the lamp support housing indicated as 52' and 54' in FIG. 11 would not fit within the closed loop channel 67 custom-formed for the contours of the downwardly extending walls 32, 60, 62 and 63 of the smallest of the lamp support housing configurations.

Turning now to FIG. 6, illustrating the middle-sized lamp assembly, this unit is characterized by having a depending spring tab or rear wall 64 which engages structure on the pin socket platform 20 to hold the lamp assembly in place. This tab or wall now has a second duty as a keying element. The lamp assembly mount 69 used with this lamp configuration defines a central closed loop cavity 68 somewhat similar to cavity 67, but at one edge of this cavity there is a relieved section 70 which defines a clearance space for the depending tab 64. As can be seen from the few parts that constitute that figure when seated, the pins 22 insert neatly in the pin sockets 24 and tab 64 into its clearance space 70.

Figure 8:
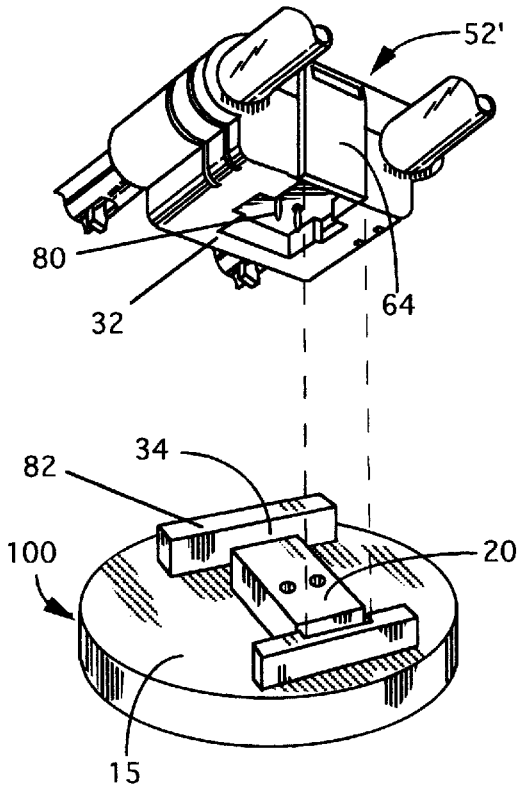
FIG. 8 is an exploded perspective of a prior art 2-pin 2D fluorescent lamp otherwise identical to that shown in FIG. 6, seating on an alternative style novel lamp assembly mount.

The tab 64 is wider and thinner than the comparable tab 72 of the C model, but with a little force the wrong tab can be pressed into the cutout, so to ensure that only the B model seats lamp supporting housing 52, the clearance and wall space 34 is provided in the embodiments of Model B as shown in both FIGS. 6 and 8.

The Model C lamp assembly mount 74, illustrated in FIG. 7, is very similar to Model B of FIG. 6, except that the tab 72 is not the same shape or size as tab 64. This model, being the largest, will not seat the Model B lamp. The lamp assembly mount 74 has a central cavity 76 around the pin socket platform 20 which also defines a relieved area 78, which will only fit the tab 72, which is possible inasmuch as the tab 64 is wider than tab 72, as can be seen from the drawings.

Figure 4:
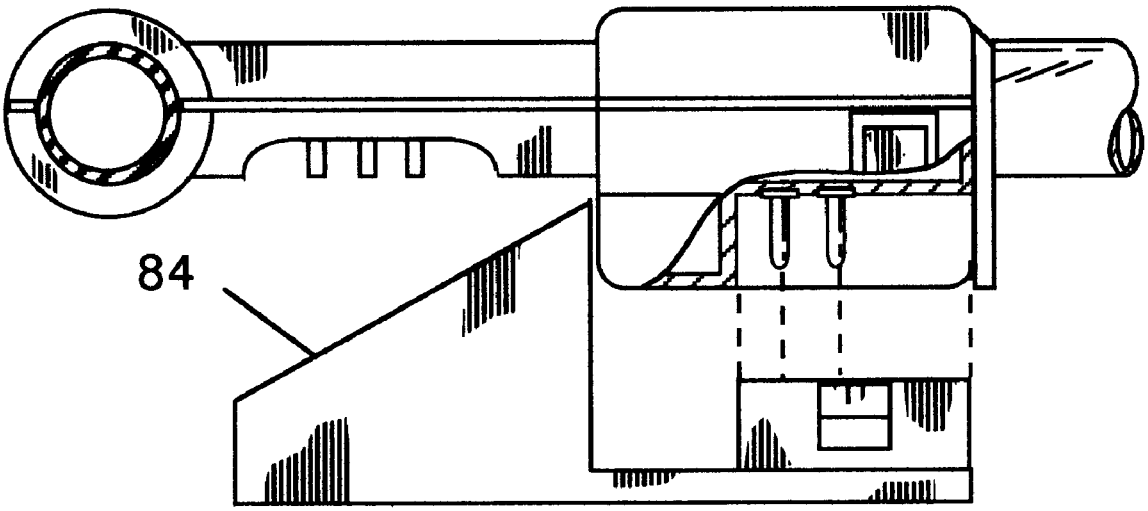
FIG. 4 is a side elevation view of the prior art 2D fluorescent lamp of FIG. 2 as it seats on a lamp assembly mount with ballast housing keying, the top surface of the ballast housing being sloped to eliminate unnecessary shadows.
Figure 9:
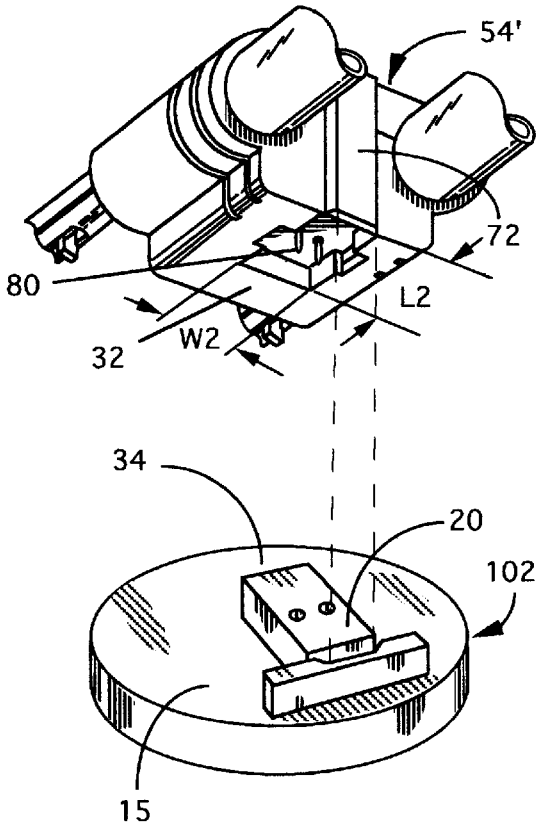
FIG. 9 is an exploded perspective of a prior art 2D fluorescent lamp identical to that of FIG. 7 but having only two pins and mounting on a novel alternative style lamp assembly mount.

A further expansion of the keying can be shown in FIGS. 8 and 9, in which the 2-pin lamp assembly mount models 100 and 102 of Model B and Model C are shown, other than the 2-pin array 80, these are identical to lamp assemblies 52 and 54 and are thus identified as 52' and 54'. Although theoretically the tab inter-fit would be adequate to key these two lamps, the addition of the spaced bar 82 of the configuration of FIG. 8 defines the above-referenced space 34 to permit the end wall to seat for additional security. The spacing and inter-fitting of these parts is best shown in FIGS. 2 and 3, wherein the thickness "b" of the front end wall corresponds to the space "b" of the lamp assembly mount shown in the same figure. In those figures, rather than using a spacer bar 82, the ballast housings themselves create the proper space, wit h those illustrated having sloped top walls 84 to eliminate shadows as can be imagined from inspecting FIG. 4.

Each of the lamp assembly mounts illustrated in FIGS. 5–11 would be electrically connected to a ballast even though the ballast has been omitted from these figures to enable the invention to be more clearly illustrated.

Any of these keying systems can be used in any type of fixture. Several different arrangements are shown in FIG. 12, there being two table lamp-type installations 86 and 88 wired straight into their lamp post housings 87 and 89 respectively, with 88 representing the switched variety. Fixtures 90 and 92 are incandescent conversions with housings 91 and 93 respectively, 90 having a 3-way screw-in base 94, and 92 having a ratchet-style base 96 which permits the 1-way frictional rotation of the lamp mount 92 in the incandescent socket in which it seats, there being enough friction to enable the unit to be securely engaged in the socket, with the free rotation permitting final adjustment to the correct angle about its axis. The ratchet locks when reverse-rotating the fixture to remove it from the socket to permit its removal. The lamp assembly mounts illustrated in the embodiments of FIGS. 12 would be electrically connected to a ballast positioned in each of their respective housings.

Thus, in any of several ways the lamp assembly mount can be specifically tailored to eliminate all but the lamp assembly of the appropriate size. Because Model C and Model D lamp assemblies each come in two different power ratings, the ballast of the lamp mount which mounts these two models can be provided as one rating or the other, or a combination of both with a selection switch. Even if the wrong power is used however, the two power ratings for either of the two-rating sizes are close enough together so that the result would not be disastrous, just a dim light, or a truncated tube life span, the possibility of making a major error having been eliminated.

The structure surrounding and laterally spaced from the bottom edge of the pin socket platform requires an open space of at least 1–17 mm from its front wall, an open space of at least 1–4 mm from its rear wall and an open space of at least 1–14 mm from each of its left and right sides. This open space may be in the form of a recess or a groove in the top surface of the base member of the lamp assembly mount. Alternatively, the bottom edge of the pin socket platform may coincide with the top surface of the base member of the lamp assembly in which case it will still require the same open space dimensions to properly receive the bottom of the lamp support housing of a 2D model fluorescent lamp.

I claim:

1. For a 2D model fluorescent lamp assembly having a fluorescent discharge tube substantially defining a planar space and delineating a substantially open area lying within said planar space, and having a lamp support housing into which the cathode-mounting ends of said discharge tube enter and are fixedly mounted, one end of said discharge tube having an exhaust tube extending therefrom inside said lamp support housing, said lamp support housing having a bottom cavity having a front wall and said cavity also defining a mechanical and electrical coupling, a space-saving lamp assembly mount comprising:

(a) a pin socket platform for engaging said coupling and electrically coupling with same;

(b) a ballast housing, having a ballast therein electrically connected to said pin socket platform and positioned adjacent to said pin socket platform in spaced relation thereto such that when said pin socket platform is mounted in said bottom cavity of said lamp support housing, said ballast-housing lies substantially entirely within said substantially open area within said planar space, whereby said ballast housing is substantially confined to within said planar space defined by said fluorescent lamp assembly, and said ballast housing is separate from the lamp support housing to avoid the heating of said ballast by the cathode-mounting ends of said fluorescent discharge tube;

(c) said discharge tube ends being inserted and fixed into one side of said lamp support housing and said ballast housing being disposed on a side of said lamp support housing opposite said one side to isolate said ballast housing from the heat of said ends of said discharge tube;

(d) said discharge tube of said fluorescent lamp extending from said one side of said lamp support housing and looping around same in spaced relation thereto to define a generally straight central segment spaced on the opposite side of said lamp support housing from said tube ends;

(e) said fluorescent lamp assembly having a pair of tube support arms extending from said lamp support housing to said central segment and supportively engaging same; the width of said open area between said pair of the support arms having a predetermined width "a" and "a" is in the range of 1.30–1.90 inches; the length of said open area between said central segment and said lamp support housing having a predetermined length "c" and "c" is in the range of 1.0–2.5 inches; and (f) said ballast housing having a width no greater than "a" and a length no greater than "c" such that said ballast housing nestles into said open area between said pair of tube support arms.

2. A lamp assembly mount as recited in claim 1 wherein said pin socket platform has a front wall and said ballast housing has a rear wall and they are spaced a predetermined distance "b" from each other; said front wall of said lamp support housing having a thickness no greater than "b" so that it may be detachably received in the space between said front wall of said pin socket platform and said rear wall of said ballast housing.

3. A lamp assembly mount as recited in claim 1 wherein said pin socket platform is mounted on a support panel that is connected to said ballast housing.

4. A lamp assembly mount as recited in claim 1 further comprising laterally oriented clips on said ballast housing for removably engaging said tube support arms.

5. A lamp assembly mount as recited in claim 1 further comprising laterally oriented clips on said pin socket platform for removably engaging said lamp support housing.

6. For a 2D model fluorescent lamp assembly having a fluorescent discharge tube substantially defining a planar space and delineating a substantially open area lying within said planar space, and having a lamp support housing into which the cathode-mounting ends of said discharge tube enter and are fixedly mounted, one end of said discharge tube having an exhaust tube extending therefrom inside said lamp support housing, said lamp support housing having a bottom cavity having a front wall and said cavity also defining a mechanical and electrical coupling, a space-saving lamp assembly mount comprising:

(a) a pin socket platform for engaging said coupling and electrically coupling with same;

(b) a ballast housing, having a ballast therein electrically connected to said pin socket platform and positioned adjacent to said pin socket platform in spaced relation thereto such that when said pin socket platform is mounted in said bottom cavity of said lamp support housing, said ballast-housing lies substantially entirely within said substantially open area within said planar space, whereby said ballast housing is substantially confined to within said planar space defined by said fluorescent lamp assembly, and said ballast housing is separate from the lamp support housing to avoid the heating of said ballast by the cathode-mounting ends of said fluorescent discharge tube;

(c) said discharge tube ends being inserted and fixed into one side of said lamp support housing and said ballast housing being disposed on a side of said lamp support housing different from said one side to isolate said ballast housing from the heat of said ends of said discharge tube;

(d) said discharge tube of said fluorescent lamp extending from said one side of said lamp support housing and looping around same in spaced relation thereto to define a generally straight central segment spaced on the opposite side of said lamp support housing from said tube ends;

(e) said fluorescent lamp assembly having at least one tube support arm extending from said lamp support housing to said central segment and supportively engaging same; the length of said open area between said central segment and said lamp support housing having a predetermined length "c" and "c" is in the range of 1.0–2.5 inches; and (f) said ballast housing having a length no greater than "c" such that said ballast housing nestles into said open area between said discharge tube and said lamp support housing and said tube support arm.

7. For a 2D model fluorescent lamp having a fluorescent discharge tube substantially defining a planar space and delineating a substantially open area lying within said planar space, and having a lamp support housing into which the ends of said discharge tube enter and are fixedly mounted, one end of said discharge tube having an exhaust tube extending therefrom inside said lamp support housing, said lamp support housing having a bottom surface having a cavity formed therein; said cavity forming surrounding substantially vertical front, left side, right side, and rear walls; said cavity having a length L1 and a width W1, a pin platform having a bottom surface is mounted in said cavity and a plurality of electrical pins extend downwardly from said bottom surface of said pin platform into said cavity; a pair of laterally spaced partitions are positioned in said cavity and they extend from said rear wall of said cavity toward said pin platform; said housing also defining a mechanical and electrical coupling; a lamp assembly mount for a 2D lamp comprising:

(a) a pin socket platform for engaging said coupling and electrically coupling with same; said pin socket platform having a front wall, a left side wall, a right side wall, a rear wall and a bottom edge; said bottom edge is connected to a support surface; said pin socket platform having a length no greater than L1 and a width no greater than W1 so that it may be removably inserted into said cavity in the bottom of said lamp support housing; said pin socket platform having a plurality of electrical pin sockets for removably receiving said electrical pins extending downwardly from said bottom surface of said pin platform for electrically connecting said fluorescent lamp to a ballast.

8. A lamp assembly mount as recited in claim 7 wherein said pin socket platform has a generally T-shaped configuration.

9. A lamp assembly mount as recited in claim 7 wherein said pin socket platform has a generally rectangular configuration and a pair of posts extend upwardly from said support surface and they are laterally spaced a predetermined distance from said respective left and right side walls of said pin socket platform at a position adjacent said rear wall and said predetermined distance is at least equal to the thickness of said left and right side walls that form and surround said cavity of said lamp support housing.

10. A lamp assembly mount as recited in claim 7 wherein said support surface for said pin socket platform is recessed in the top surface of a base member and the recess formed therein has a 4-sided configuration having a front wall, a left side wall, a right side wall, a rear wall and said front and rear walls of said pin socket platform are spaced a predetermined distance ffrom said respective front and rear walls of said recess and said predetermined distance is substantially equal to the thickness of said front and rear walls that form said cavity of said lamp support housing.

11. For a 2D model fluorescent lamp having a fluorescent discharge tube substantially defining a planar space and delineating a substantially open area lying within said planar space, and having a lamp support housing into which the ends of said discharge tube enter and are fixedly mounted, one end of said discharge tube having an exhaust tube extending therefrom inside said lamp support housing, said lamp support housing having a bottom surface having a cavity formed therein; said cavity forming surrounding substantially vertical front, left side, right side and rear walls and these walls all have predetermined thicknesses; said cavity having a length L2 and a width W2; a pin platform having a bottom surface is mounted in said cavity and a plurality of electrical pins extend downwardly from said bottom surface of said pin platform into said cavity; said housing also defining a mechanical and electrical coupling, a lamp assembly mount for a 2D lamp comprising:

(a) a pin socket platform for engaging said coupling and electrically coupling with same; said pin socket platform having a front wall, a left side wall, a right side wall, a rear wall and a bottom edge; said bottom edge is connected to a support surface; said support surface for said pin socket platform is recessed in the top surface of a base member and the recess formed therein has a 4-sided configuration having a front wall, a left side wall, a right side wall, a rear wall and said front, left side, right side and rear walls of said pin socket platform are spaced a predetermined distance from said respective front, left side, right side, and rear walls of said recess and said predetermined distances are substantially equal to the thicknesses of said respective front, left side, right side, and rear walls that form and surround said cavity of said lamp support housing; said pin socket platform having a length no greater than L2 and a width no greater than W2 so it may be removably inserted into said cavity in the bottom of said lamp support housing; said pin socket platform having at least as many electrical pin sockets as there are electric pins for removably receiving said electrical pins extending downwardly from said bottom surface of said pin platform for electrically connecting said fluorescent lamp to a ballast.

12. For a 2D model fluorescent lamp having a fluorescent discharge tube substantially defining a planar space and delineating a substantially open area lying within said planar space, and having a lamp support housing into which the ends of said discharge tube enter and are fixedly mounted, one end of said discharge tube having an exhaust tube extending therefrom inside said lamp support housing, said lamp support housing having a bottom surface having a cavity formed therein; said cavity forming surrounding substantially vertical front, left side, right side and rear walls and these walls all have predetermined thicknesses; said cavity having a length L2 and a width W2; a pin platform having a bottom surface is mounted in said cavity and a plurality of electrical pins extend downwardly from said bottom surface of said pin platform into said cavity; said housing also defining a mechanical and electrical coupling, a lamp assembly mount for a 2D lamp comprising:

(a) a pin socket platform for engaging said coupling and electrically coupling with same; said pin socket platform having a front wall, a left side wall, a right side wall, a rear wall and a bottom edge; said bottom edge is connected to a support surface; said support surface for said pin socket platform is recessed in the top surface of a base member and the recess formed therein only has a 3-sided configuration having, a left side wall, a right side wall, a rear wall and said left side, right side and rear walls of said pin socket platform are spaced a predetermined distance from said respective, left side, right side, and rear walls of said recess and said predetermined distances are substantially equal to the thicknesses of said respective left side, right side, and rear walls that form and surround said cavity of said lamp support housing; said pin socket platform having a length no greater than L2 and a width no greater than W2 so it may be removably inserted into said cavity in the bottom of said lamp support housing; said pin socket platform having at least as many electrical pin sockets as there are electric pins for removably receiving said electrical pins extending downwardly from said bottom surface of said pin platform for electrically connecting said fluorescent lamp to a ballast.

13. For a 2D model fluorescent lamp having a fluorescent discharge tube substantially defining a planar space and delineating a substantially open area lying within said planar space, and having a lamp support housing into which the ends of said discharge tube enter and are fixedly mounted, one end of said discharge tube having an exhaust tube extending therefrom inside said lamp support housing, said lamp support having a bottom surface having a cavity formed therein; said cavity forming surrounding substantially vertical front, left side, right side and rear walls and these walls all have predetermined thicknesses; said cavity having a length L2 and a width W2; a pin platform having a bottom surface is mounted in said cavity and a pair of electrical pins extend downwardly from said bottom surface of said pin platform into said cavity; said lamp support housing also defining a mechanical and electrical coupling; a lamp assembly mount for a 2D lamp comprising:

(a) a pin socket platform for engaging said coupling and electrically coupling with same; said pin socket platform having a front wall, a left side wall, a right side wall, a rear wall and a bottom edge; said bottom edge is connected to a support surface; said support surface for said pin socket platform is the top surface of a base member; a first space bar is positioned on said support surface a predetermined distance from one of the front or rear walls of said pin socket platform; said predetermined distance is substantially equal to the thickness of said respective rear wall of said cavity of said lamp support housing; said pin socket platform having a length no greater than L2 and a width no greater than W2 so it may be removably inserted into said cavity in the bottom of said lamp support housing; said pin socket platform having at least as many electrical pin sockets as there are electrical pins extending downwardly from said bottom surface of said pin platform for electrically connecting said fluorescent lamp to a ballast.

14. A lamp assembly mount as recited in claim 12 further comprising a second space bar positioned on said support surface a predetermined distance from the other of said front or rear walls of said pin socket platform; said predetermined distance is substantially equal to the thickness of said respective front wall of said cavity of said lamp support housing; said pin socket platform having a length no greater than L2 and a width no greater than W2 so it may be removably inserted into said cavity in the bottom of said lamp support housing; said pin socket platform having at least as many electrical pin sockets as there are electric pins extending downwardly from said bottom surface of said pin platform for electrically connecting said fluorescent lamp to a ballast.

15. For a 2D model fluorescent lamp having a fluorescent discharge tube substantially defining a planar space and delineating a substantially open area lying within said planar space, and having a lamp support housing into which the ends of said discharge tube enter and are fixedly mounted, one end of said discharge tube having an exhaust tube extending therefrom inside said lamp support housing, said lamp support housing having a bottom surface having a cavity formed therein; said cavity forming surrounding substantially vertical front, left side, right side, and rear walls; said cavity having a length L1 and a width W1, a pin platform having a bottom surface is mounted in said cavity and a plurality of electrical pins extend downwardly from said bottom surface of said pin platform into said cavity; a pair of lain said cavity partitions are positioned in said cavity and they extend from said rear wall of said cavity to said pin platform; said housing also defining a mechanical and electrical coupling; a lamp assembly mount for a 2D lamp comprising:

(a) a pin socket platform for engaging said coupling and electrically coupling with same; said pin socket platform having a front wall, a left side wall, a right side wall; a rear wall and a bottom edge; said pin socket platform having a length no greater than L1 and a width no greater than W1 so that it may be removably inserted into said cavity in the bottom of said lamp support housing; said pin socket platform having a plurality of electrical pin sockets for removably receiving said electrical pins extending downwardly from said bottom surface of said pin platform for electrically connecting said fluorescent lamp to a ballast.

* * * * *